US006557639B1

(12) United States Patent
Matthews et al.

(10) Patent No.: US 6,557,639 B1
(45) Date of Patent: May 6, 2003

(54) APPARATUS AND METHOD FOR PUMPING FLUIDS FOR USE WITH A DOWNHOLE ROTARY PUMP

(75) Inventors: Ed Matthews, Kitscoty (CA); Gary Anderson, Calgary (CA); Shawn Deugo, Calgary (CA); Jim Anaka, Lashburn (CA); Mel Paton, Pierceland (CA)

(73) Assignee: Innovative Production Technologies Ltd., Edmonton (CA)

( * ) Notice: Subject to any disclaimer, the term of this patent is extended or adjusted under 35 U.S.C. 154(b) by 14 days.

(21) Appl. No.: 09/684,566

(22) Filed: Oct. 7, 2000

(30) Foreign Application Priority Data

Oct. 19, 1999 (CA) ..... 2286823

(51) Int. Cl.[7] ..... E21B 43/00

(52) U.S. Cl. ..... 166/369; 166/68.5; 166/73; 166/105; 417/374

(58) Field of Search ..... 166/369, 68, 68.5, 166/73, 105; 417/374, 448

(56) References Cited

U.S. PATENT DOCUMENTS

| | | | | |
|---|---|---|---|---|
| 4,661,052 A | | 4/1987 | Ruhle | |
| 5,139,090 A | | 8/1992 | Land | |
| 5,220,962 A | | 6/1993 | Muller et al. | |
| 5,327,975 A | | 7/1994 | Land | |
| 5,351,752 A | | 10/1994 | Wood et al. | |
| 5,431,230 A | | 7/1995 | Land et al. | |
| 5,667,369 A | | 9/1997 | Cholet | |
| 5,697,768 A | * | 12/1997 | Mills | 166/117.7 |
| 6,220,358 B1 | * | 4/2001 | Leniek | 166/369 |

FOREIGN PATENT DOCUMENTS

| | | |
|---|---|---|
| CA | 1180594 | 8/1985 |
| CA | 2111492 | 10/1994 |
| SU | 662705 | 5/1979 |

* cited by examiner

*Primary Examiner*—David Bagnell
*Assistant Examiner*—Jennifer R. Dougherty
(74) *Attorney, Agent, or Firm*—Terrence N. Kuharchuk; Rodman & Rodman

(57) ABSTRACT

An apparatus and method for pumping fluids in a wellbore. The apparatus includes a pipe string in the wellbore extending between a wellhead end and a production end, the pipe string defining an interior fluid path. A swivel device is connected into the pipe string so that an upper portion of the pipe string rotates relative to a lower portion thereof. A lower connector connects the lower portion with a stator of a rotary pump such that a fluid pumped by the pump is conducted through the interior fluid path of the pipe string. An upper connector connects the upper portion with a rotor of the rotary pump such that rotation of the upper portion rotates the rotor and thus pumps the fluid. The method includes rotatably supporting the upper portion in the wellbore at the wellhead end, connecting the lower portion with the stator, connecting the upper portion with the rotor, positioning the pump in the wellbore and rotating the upper portion in order to rotate the rotor to pump the fluid.

25 Claims, 5 Drawing Sheets

APPARATUS AND METHOD FOR PUMPING FLUIDS FOR USE WITH A DOWNHOLE ROTARY PUMP

FIELD OF INVENTION

The present invention relates to an apparatus and a method for use in pumping fluids in a wellbore, wherein the apparatus and method are for use with a downhole rotary pump. Further, the present invention relates to an apparatus and a method wherein a pipe string defining an interior fluid path for the passage of the fluids therein is used to actuate the downhole rotary pump.

BACKGROUND OF INVENTION

To produce downhole production fluids from a wellbore to the surface, conventional production systems typically include a tubing string extending from a wellhead at the surface through the wellbore to the hydrocarbon producing formation. The downhole end of the tubing string is connected with a downhole pump which typically pumps the production fluids from the formation and to the surface through the tubing string. Further, the pump is actuated by a rotating or reciprocating rod string which extends within the tubing string from the wellhead at the surface to the downhole pump. Similar systems are provided for injecting fluids from the surface downhole through the wellbore to the formation.

For instance, in a conventional downhole rotary pump, commonly referred to as a progressive cavity pump, the rod string is rotated within the tubing string by a motor associated with the wellhead at the surface. Rotation of the rod string actuates a rotor within the downhole pump in order to produce the downhole production fluids to the surface. More particularly, the production fluids are pumped to the surface within the tubing string in the annular space formed between the rod string and the tubing string.

Alternately, in a downhole pump including a reciprocating plunger for pumping the production fluids, the rod string is reciprocated within the tubing string by a walking beam or other pump drive system associated with the wellhead at the surface which vertically lifts or reciprocates the rod string. Reciprocation of the rod string actuates the reciprocating plunger within the downhole pump to produce the downhole production fluids to the surface.

However, actuation of the downhole pump by the rotation or reciprocation of the rod string within the tubing string has not been found to be fully satisfactory for various reasons. For instance, it has been found that the rod string tends to be prone to structural failure. Structural failure of the rod string is particularly prevalent where the rod string is subjected to an amount of torque in order to rotate the rod string and thereby rotate the rotor within the downhole pump.

Further, where a rotating rod string is used to actuate the downhole pump, it has been found that the rod string may not be able to provide a required or desired amount of torque to the rotor of the pump to optimize the operation or functioning of the downhole pump. In other words, the downhole pump may not be able to be used efficiently or to its maximum capacity due to the limitations inherent in the structure of the rod string and the potential for its failure.

As well, the rotation of the rod string to actuate the pump tends to cause wearing of the tubing string and rod string failure as a result of abrasion between the rod string and the inner surface of the tubing string. For instance, the rod string may include a plurality of rods interconnected by rod couplings and may be connected to the downhole rotary pump by a further coupling referred to as a shear coupling located just above the rotary pump. The rod couplings and the shear coupling are larger in diameter than the rods comprising the rod string.

As a result, wearing occurs along the length of the rod string but tends to be greatest at the locations where the rod couplings and the shear coupling contact the inner surface of the tubing string. Wearing of the inner surface of the tubing string can result in a hole developing in the tubing string and a possible loss of production fluids due to leakage. Further, where high concentrations of silt and sand are produced from the wellbore along with the production fluids, the abrasive nature of the silt and sand accelerates the wearing that occurs between the rod string and the inner surface of the tubing. In addition, the wearing is further accelerated when the wellbore being produced is slant, directionally or horizontally drilled.

Various attempts have been made to address these issues by eliminating the need for or the use of the rod string. However, none of these attempts have been fully satisfactory, particularly when using a downhole rotary pump or a progressive cavity pump to produce the production fluids from the formation.

For instance, attempts have been made to eliminate the use of a reciprocating rod string to actuate a downhole reciprocating pump. United States of America U.S. Pat. No. 4,661,052 issued Apr. 28, 1987 to Ruhle describes a downhole reciprocating pump including a pump plunger, which is activated by the axial oscillation or reciprocation of a string of lightweight composite pipe. The string of pipe is axially oscillated from the surface. More particularly, the string of pipe is provided to activate the reciprocating pump by axially oscillating the pump plunger and to transport the production fluids to the surface.

United States of America U.S. Pat. No. 5,351,752 issued Oct. 4, 1994 to Wood et. al. also describes a downhole reciprocating pump including a reciprocating pump plunger. Specifically, a tubing string is connected between a pump drive at the surface, referred to as a jack unit, and the downhole reciprocating pump. The tubing string performs the dual function of reciprocating the pump plunger in response to activation of the pump drive at the surface and transporting production fluids from the formation to the surface.

Further, attempts have been made to eliminate the use of a rotating rod string to actuate a downhole pump. United States of America U.S. Pat. No. 5,220,962 issued Jun. 22, 1993 to Muller et. al. describes the use of a rotating tubing string to activate a particular downhole pump. Specifically, the downhole pump is comprised of a first section, a second section and a third section. The first section of the downhole pump is connected to the downhole end of the tubing string and rotates circumferentially in response to the rotation of the tubing string. The second section of the downhole pump is connected to the first section and reciprocates longitudinally in response to the rotation of the first section. The third section is connected to the second section and receives the production fluids from the wellbore and subsequently pushes the fluids uphole in response to the longitudinal reciprocation of the second section.

United States of America U.S. Pat. No. 5,667,369 issued Sep. 16, 1997 to Cholet describes the use of a continuous tube or continuous length of coil tubing in place of the rod string to activate the downhole rotary pump. Specifically, a tubular column extends from the surface for connection to the downhole rotary pump. The tubular column is described as a "production column" which has as its main role the channeling of the production fluids from the bottom of the wellbore to the surface "via its inner pipe". The coil tubing extends from the surface through the production column for connection to a rotor of the downhole rotary pump. Thus, rotation of the coil tubing within the production column drives the rotor of the rotary pump.

Thus, there remains a need in the industry for a downhole production system and method which address the disadvantages associated with the conventional use of a rod string to actuate a downhole pump.

SUMMARY OF INVENTION

The present invention relates to an apparatus and a method for use in pumping fluids in a wellbore. Further, the apparatus and method are preferably for use with a downhole rotary pump. More particularly, a pipe string defining an interior fluid path for the passage of the fluids therein actuates the downhole rotary pump in order to pump the fluids. Preferably, the pipe string is comprised of a tubing string rotatably supported within the wellbore. Thus, the pipe string preferably performs the dual function of providing a fluid path for the passage of the fluids and actuating the downhole rotary pump.

Although the apparatus and the method may be used for injecting fluids in the wellbore from the surface downhole to a desired underground formation, the apparatus and method are preferably used for producing fluids in the wellbore from the underground formation to the surface. Further, the apparatus and the method may be used for pumping any fluids, which fluid may be comprised of any liquids, gases or a combination thereof. However, the fluid is preferably comprised of a hydrocarbon, such that the apparatus and the method are preferably used for pumping production fluids from an underground hydrocarbon producing formation. The fluid may also contain an amount of solid material such as sand or debris from the wellbore.

In a first aspect of the invention, the invention is comprised of an apparatus for use in pumping fluids in a wellbore. The apparatus comprises:

(a) a pipe string positioned in the wellbore and extending between a wellhead end of the pipe string and a production end of the pipe string, the pipe string defining an interior fluid path from the wellhead end to the production end;

(b) a swivel device connected into the pipe string between the wellhead end and the production end so that an upper portion of the pipe string between the wellhead end and the swivel device may rotate relative to a lower portion of the pipe string between the swivel device and the production end;

(c) a lower connector for connecting the lower portion of the pipe string with a stator of a rotary pump positioned at the production end of the pipe string such that a fluid which is pumped by the pump is conducted through the interior fluid path of the pipe string; and (d) an upper connector for connecting the upper portion of the pipe string with a rotor of the rotary pump such that rotation of the upper portion of the pipe string will result in rotation of the rotor and in pumping of the fluid by the pump.

In a second aspect of the invention, the invention is comprised of a method for pumping fluids from a wellbore. The method is comprised of the following steps:

(a) rotatably supporting an upper portion of a pipe string in a wellbore at a wellhead end of the pipe string;

(b) connecting a lower portion of the pipe string with a stator of a rotary pump at a production end of the pipe string, wherein the upper portion of the pipe string and the lower portion of the pipe string are capable of rotating relative to each other;

(c) connecting the upper portion of the pipe string with a rotor of the rotary pump;

(d) positioning the pump in the wellbore; and (e) rotating the upper portion of the pipe string in order to rotate the rotor of the rotary pump to pump a fluid and in order to conduct the fluid through an interior fluid path in the pipe string.

The method of the within invention may be performed by any apparatus suitable for, and capable of, performing the method. However, preferably, the apparatus of the within invention is used to perform the method. More preferably, the preferred embodiment of the apparatus, as described herein, is used to perform the method.

In the first aspect of the invention, the swivel device may be comprised of any apparatus, structure or mechanism which may be connected into the pipe string and which provides for or permits the rotation of the upper portion of the pipe string relative to the lower portion of the pipe string. Further, the swivel device may be connected into the pipe string in any manner and by any mechanism, structure or method. For instance, the swivel device may be integrally formed with the upper portion and the lower portion of the pipe string. Alternately, the swivel device may be fixedly connected with the pipe string, such as by welding, or it may be removably coupled or attached with the pipe string, such as by a threaded coupling or sub.

However, the swivel device is preferably comprised of a housing for containing a lower end of the upper portion of the pipe string and for containing an upper end of the lower portion of the pipe string. Further, the housing is preferably comprised of an upper housing support for engaging the upper portion of the pipe string and a lower housing support for engaging the lower portion of the pipe string, wherein the lower portion of the pipe string and the upper portion of the pipe string are rotatably supported relative to each other by the upper housing support and the lower housing support.

At least one of the upper housing support and the lower housing support preferably permit rotation of the housing relative to the pipe string. For instance, the upper housing support may permit rotation of the housing relative to the pipe string. Thus, the upper portion of the pipe string will be permitted to rotate relative to the housing, which preferably remains substantially stationary. Alternatively, the lower housing support may permit rotation of the housing relative to the pipe string. Thus, the upper portion of the pipe string and the housing will be permitted to rotate together as a unit relative to the lower portion of the pipe string, which preferably remains substantially stationary.

In the preferred embodiment, both the upper housing support and the lower housing support permit rotation of the housing relative to the pipe string. Thus, in the event that one of the upper or lower housing supports fails or otherwise does not permit rotation of the housing relative to the portion of the pipe string contained therein, then the other housing support will continue to permit such relative rotation and the continued functioning of the swivel device. In this manner, the useful life of the swivel device may be extended.

The upper and lower housing supports may be each comprised of any structure, mechanism or device able to engage and support the adjacent upper and lower portions of the pipe string respectively. Further, at least one, and preferably both, of the upper and lower housing supports is comprised of a structure, mechanism or device able to rotatably support the upper and lower portions of the pipe string respectively such that the housing is permitted to rotate relative to the portion of the pipe string contained therein.

Preferably, the upper housing support supports the upper portion of the pipe string both radially and axially. Similarly, the lower housing support preferably supports the lower portion of the pipe string both radially and axially. Thus, in the preferred embodiment, at least one, and preferably both, of the upper and lower housing supports is comprised of at least one thrust bearing for supporting the pipe string axially and at least radial bearing for supporting the pipe string radially.

Further, the swivel device is preferably comprised of an upper seal assembly for sealing between the upper portion of the pipe string and the housing and a lower seal assembly for sealing between the lower portion of the pipe string and the housing. Each seal assembly may be comprised of one or more seals, sealing devices or other suitable sealing structures able to provide the desired sealing between the pipe string and the housing.

The upper connector of the apparatus may be comprised of any apparatus, structure or mechanism capable of connecting the upper portion of the pipe string with the rotor of the rotary pump such that rotation of the upper portion of the pipe string will result in rotation of the rotor. For instance, the upper connector may be integrally formed into or with one or both of the upper portion of the pipe string and the rotor of the rotary pump. Alternately, the upper connector may be fixedly connected into or with one or both of the upper portion of the pipe string and the rotor, such as by welding, or it may be removably coupled or attached into or with one or both of the upper portion of the pipe string and the rotor, such as by a threaded coupling or connection.

However, preferably, the upper connector is comprised of a drive sub collar which is connected into the upper portion of the pipe string such that rotation of the upper portion of the pipe string will result in rotation of the drive sub collar. The drive sub collar may be connected, coupled or otherwise mounted into the upper portion of the pipe string by any structure, mechanism or device able to provide the necessary connection. For instance, as indicated above, the drive sub collar may be integrally formed into the pipe string, fixedly connected into the pipe string such as by welding, removably connected into the pipe string such as by a threaded connection or a combination thereof.

Further, the drive sub collar is preferably comprised of a rotor connector for connecting the rotor of the pump to the drive sub collar such that rotation of the upper portion of the pipe string and the drive sub collar will result in rotation of the rotor. The rotor connector may be comprised of any apparatus, structure or mechanism capable of connecting the rotor of the rotary pump to the drive sub collar. In addition, the rotor connector may be integrally formed with one or both of the drive sub collar and the rotor of the rotary pump. Alternately, the rotor connector may be fixedly connected or mounted with one or both of the drive sub collar and the rotor, such as by welding, or it may be removably coupled or attached with one or both of the drive sub collar and the rotor, such as by a threaded coupling or connection.

As well, in the preferred embodiment, the rotor connector is located concentrically within the drive sub collar so that the drive sub collar and the rotor connector are rotatable about a common axis.

Further, the drive sub collar is preferably comprised of an upper end and a lower end. In addition, the drive sub collar preferably defines an interior fluid passage for permitting fluid to be conducted between the upper end and the lower end of the drive sub collar. In the preferred embodiment, the interior fluid passage defined by the drive sub collar is comprised of a plurality of fluid channels surrounding the rotor connector. Thus, the drive sub collar does not significantly interfere with or impede the passage of fluids through the interior fluid path defined by the pipe string.

The lower connector of the apparatus may be comprised of any apparatus, structure or mechanism capable of connecting the lower portion of the pipe string with the stator of the rotary pump such that fluid pumped by the rotary pump is conducted through the interior fluid path of the pipe string. For instance, the lower connector may be integrally formed into or with one or both of the lower portion of the pipe string and the stator of the rotary pump. However, alternately, the lower connector may be fixedly connected into or with one or both of the lower portion of the pipe string and the stator, such as by welding, or it may be removably coupled or attached into or with one or both of the lower portion of the pipe string and the stator, such as by a threaded coupling or connection.

Preferably, the lower connector is comprised of a sub or collar which is connected into or with the lower portion of the pipe string, preferably between the production end of the pipe string and the stator of the rotary pump positioned at the production end. The collar may be connected, coupled or otherwise mounted between the lower portion of the pipe string at the production end and the stator by any structure, mechanism or device able to provide the necessary connection. In the preferred embodiment, the collar is integrally formed with one or both of the lower portion of the pipe string and the stator, preferably with the lower portion. However, alternately, the collar may be fixedly connected with one or both of the lower portion of the pipe string and the stator such as by welding, removably connected with one or both of the lower portion of the pipe string and the stator such as by a threaded connection or a combination thereof.

Further, the pipe string is comprised of an exterior surface. Preferably, the apparatus is further comprised of at least one stabilizing collar mounted on the exterior surface of the upper portion of the pipe string for centralizing the pipe string in the wellbore. More preferably, the apparatus is comprised of a plurality of stabilizing collars spaced longitudinally along the upper portion of the pipe string.

The stabilizing collar may be comprised of any structure, mechanism or device capable of centralizing the upper portion of the pipe string within the wellbore, particularly upon the rotation of the upper portion in the wellbore. Further, the stabilizing collar may be fixedly mounted with the exterior surface by any mechanism, structure or device capable of fixedly mounting, connecting or affixing the stabilizing collar thereto such that the stabilizing collar rotates with the upper portion of the pipe string.

However, preferably, the stabilizing collar is rotatably mounted on the exterior surface of the upper portion of the pipe string. Thus, the upper portion of the pipe string is rotatable within, or relative to, the stabilizing collar. In this case, the stabilizing collar may be rotatably mounted with the exterior surface by any mechanism, structure or device capable of rotatably mounting, connecting or affixing the stabilizing collar thereto such that the upper portion of the pipe string is permitted to rotate relative to the stabilizing collar.

In the preferred embodiment, the stabilizing collar is comprised of an inner surface for surrounding the exterior surface of the pipe string. Further, the stabilizing collar is comprised of an outer sleeve for contacting an inner wellbore surface. The outer sleeve is preferably comprised of a material which will not abrade substantially the inner wellbore surface. Although any non-abrading material may be used, in the preferred embodiment, the outer sleeve of the stabilizing collar is comprised of a polyurethane.

The apparatus may be further comprised of a wellhead support located at the wellhead end of the pipe string for supporting the pipe string in the wellbore. Preferably, the wellhead support rotatably supports the pipe string in the wellbore.

Finally, the apparatus is preferably further comprised of a drive system connected with the upper portion of the pipe string for rotating the upper portion of the pipe string. Accordingly, actuation of the drive system actuates the rotary pump. Specifically, actuation of the drive system rotates the upper portion of the pipe string connected with the rotor of the rotary pump and thereby results in rotation of the rotor and pumping of the fluid by the rotary pump.

The drive system may be connected with the upper portion of the pipe string at any location or position longitudinally along the length of the pipe string between the wellhead end of the pipe string and the lower end of the upper portion of the pipe string. However, preferably, the drive system is connected with the upper portion of the pipe string at, adjacent or in proximity to the wellhead end of the pipe string.

In the second aspect of the invention, the step of rotatably supporting the upper portion of the pipe string may be performed in any manner and using any method, structure, mechanism or device capable of rotatably supporting the upper portion in the wellbore at, adjacent or in proximity to the wellhead end of the pipe string. However, the rotatably supporting step is preferably performed by providing the wellhead support, described above for the apparatus embodiment of the invention, at the wellhead end of the pipe string. Further, the rotatably supporting step is preferably comprised of mounting, connecting, coupling or otherwise associating the upper portion of the pipe string with the wellhead support at, adjacent or in proximity to the wellhead end of the pipe string in a manner such that the pipe string is rotatably supported within the wellbore by the wellhead support.

Further, the step of connecting the lower portion of the pipe string with the stator may be performed in any manner and using any method, structure, mechanism or device capable of connecting the lower portion and the stator such that the fluid pumped by the pump may be conducted through the interior fluid path of the pipe string. However, the lower portion connecting step is preferably performed by providing the lower connector, described above for the apparatus embodiment of the invention, for connecting the lower portion of the pipe string with the stator. Further, the lower portion connecting step is preferably comprised of mounting, connecting, coupling or otherwise associating the lower portion at the production end of the pipe string and the stator with the lower connector in a manner such that the fluid may be conducted between the pump and the interior fluid path of the pipe string.

The step of connecting the upper portion of the pipe string with the rotor may be performed in any manner and using any method, structure, mechanism or device capable of connecting the upper portion and the rotor such that rotation of the upper portion results in rotation of the rotor. However, the upper portion connecting step is preferably performed by providing the upper connector, described above for the apparatus embodiment of the invention, for connecting the upper portion of the pipe string with the rotor. Further, the upper portion connecting step is preferably comprised of mounting, connecting, coupling or otherwise associating the upper portion of the pipe string and the rotor with the upper connector in a manner such that rotation of the upper portion results in rotation of the rotor and thus, pumping of the fluid.

The rotating step may be performed in any manner and using any method, structure, mechanism or device capable of rotating the upper portion of the pipe string in the wellbore. However, the rotating step is preferably performed by providing the drive system, described above for the apparatus embodiment of the invention. Further, the rotating step is preferably comprised of mounting, connecting, coupling or otherwise associating the upper portion of the pipe string with the drive system, preferably at, adjacent or in proximity to the wellhead end of the pipe string.

The positioning step may be performed in any manner and using any method, structure, mechanism or device capable of positioning the pump in the wellbore. The positioning step may be performed prior to one or both of the upper portion connecting step and the lower portion connecting step. Thus, the pump may be positioned in the wellbore before being connected with the pipe string, or with either or both of the upper and lower portions of the pipe string. However, the positioning step is preferably performed following the upper portion connecting step and the lower portion connecting step. Thus, preferably, the pump is positioned in the wellbore after being connected with the pipe string. In other words, the pump is preferably positioned in the wellbore after being connected with both the upper portion and the lower portion of the pipe string.

Finally, the method of the within invention may be further comprised of the step of anchoring the stator in the wellbore during rotation of the upper portion of the pipe string in order to inhibit rotation of the stator. The anchoring step may be performed in any manner and using any method, structure, mechanism or device capable of anchoring the stator in the wellbore. However, the anchoring step is preferably performed by mounting, connecting, coupling or otherwise associating an anchor or anchoring device, such as a torque anchor, with the stator of the rotary pump.

BRIEF DESCRIPTION OF DRAWINGS

Embodiments of the invention will now be described with reference to the accompanying drawings, in which.

DETAILED DESCRIPTION

Figure 1:
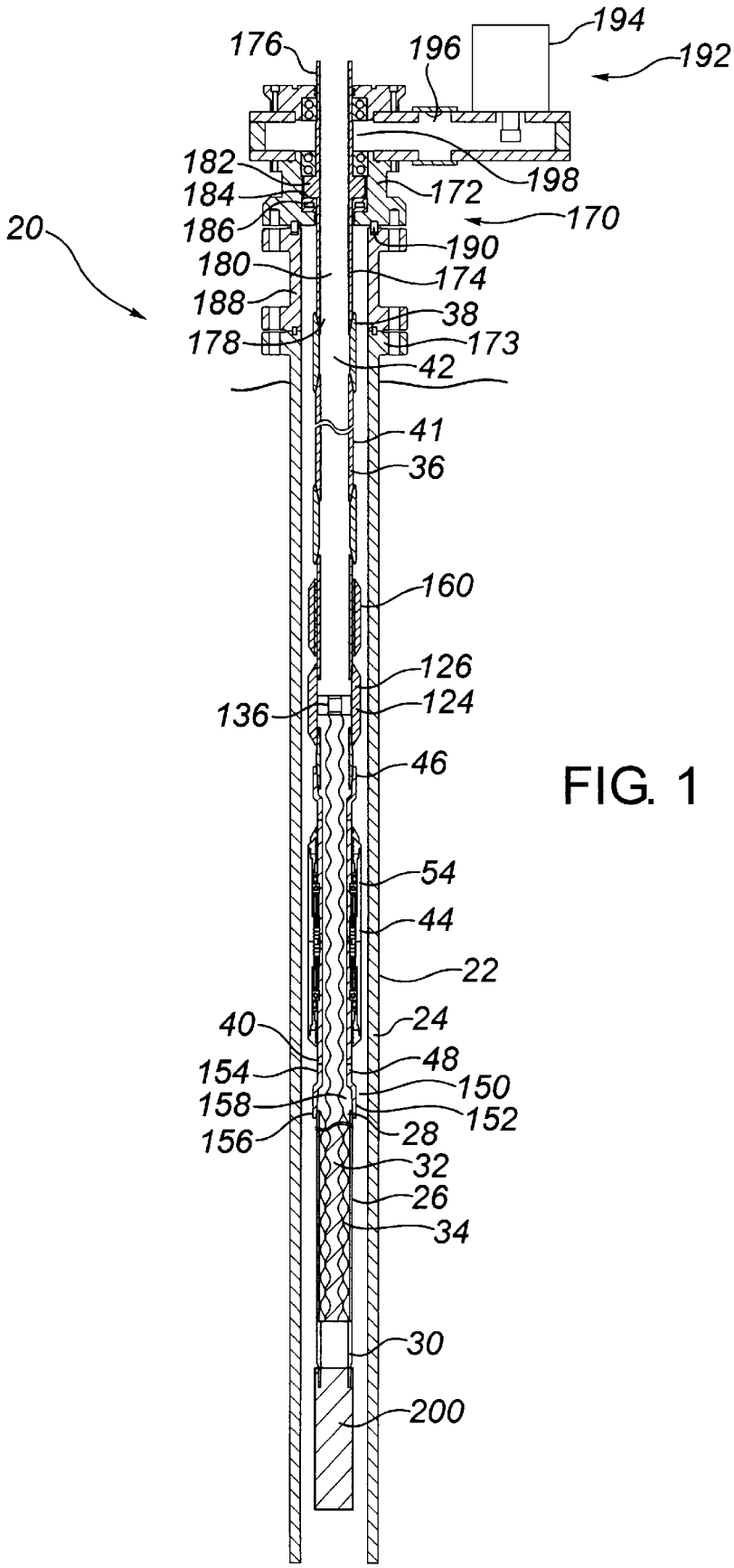
FIG. 1 is a pictorial side view of a wellbore and an associated wellhead of a production well of the type having a rotating rod string, in which a preferred embodiment of the apparatus of the within invention is shown therein.
Figure 2:
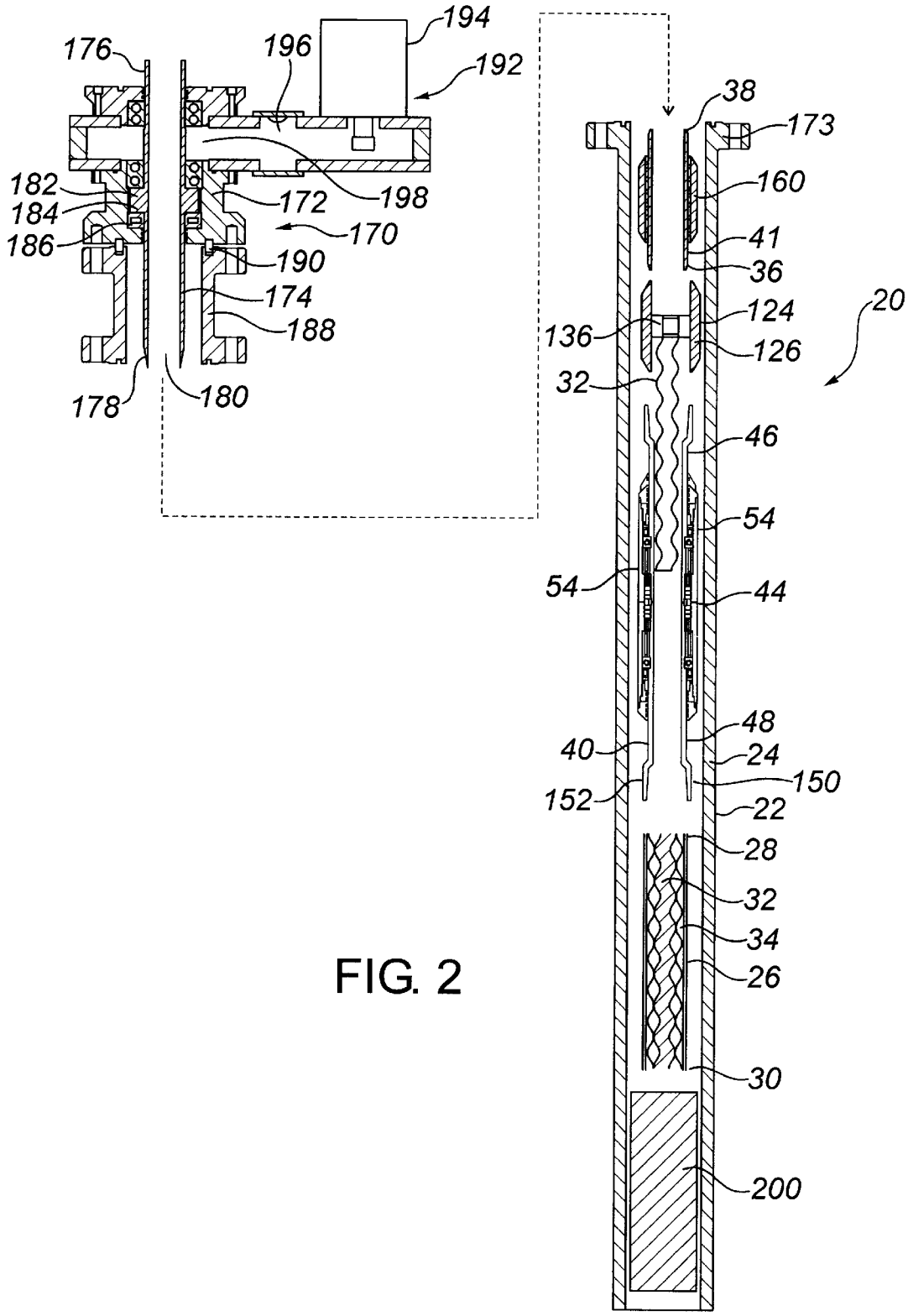
FIG. 2 is an exploded longitudinal sectional view of the preferred embodiment of the apparatus shown in FIG. 1.

Referring to FIG. 1 and FIG. 2, the within invention relates to an apparatus (20) and a method for use in pumping fluids in a wellbore (22). More particularly, the apparatus and the method may be used for injecting fluids from the surface through the wellbore (22) downhole to a desired underground formation. However, preferably, the invention and the method are used for producing fluids to the surface through the wellbore (22) from the underground formation.

The wellbore (22) may be completed in any manner so long as communication is provided between the wellbore (22) and the surrounding formation such that the fluid may pass therebetween. Referring to FIGS. 1 and 2, preferably, at least a portion of the wellbore (22) is cased. Thus, a casing string (24) extends from the surface for a distance downhole.

Further, the apparatus (20) and the method may be used for pumping any type or composition of fluid. Thus, the fluid may be comprised of one or more liquids, one or more gases or a combination thereof. The fluid may also contain an amount of a solid material such as sand or debris from the wellbore. In the preferred embodiment in which the apparatus (20) is used for producing the fluid to the surface, the fluid is preferably comprised of a hydrocarbon. Thus, the downhole end of the wellbore (22) extends within a hydrocarbon producing formation such that the hydrocarbons may pass from the formation into the wellbore (22) for pumping to the surface.

In addition, the apparatus (20) and the method are used or performed in combination with a downhole rotary pump (26). More particularly, the rotary pump (26) has an upper end (28) and a lower end (30) and is of a type comprised of a rotatable rotor (32) housed or contained within a stator (34). Specifically, the rotary pump (26) is actuated by the rotation of the rotor (32) within, or relative to, the stator (34) resulting in the pumping of fluid thereby. Any rotary pump (26) including a rotor (32) and a stator (34) may be used with the apparatus (20) and method of the within invention. However, the rotary pump (26) is preferably compatible with, and suitable for, the pumping of the production fluid from the hydrocarbon producing formation. In the preferred embodiment, the rotary pump (26) is of the type commonly referred to as a downhole progressing or progressive cavity pump.

The apparatus (20) is comprised of a pipe string (36) which is positioned in the wellbore (22). The pipe string (36) may be comprised of any tubular member, pipe or conduit capable of conducting fluid therethrough such as a length of coiled tubing. However, in the preferred embodiment, the pipe string (36) is comprised of a tubing string or production tubing within the wellbore (22) comprised of one or more joints or lengths of tubing interconnected by one or more tubing string collars (not shown). The pipe string (36) or tubing string is rotatable within the wellbore (22) and connected with the rotary pump (26) in a manner such that the rotation of the pipe string (36) actuates the rotary pump (26) to pump the fluid.

The pipe string (36) includes and extends between a wellhead end (38) and a production end (40). The wellhead end (38) is preferably located or positioned at, adjacent or in proximity to the ground surface and is associated with the wellhead of the production well as described further below. The production end (40) is positioned downhole of the wellhead end (38) within the wellbore (22). Further, the rotary pump (26) is positioned in the wellbore (22) at, adjacent or in proximity to the production end (40) of the pipe string (36).

Further, the pipe string (36) has an exterior surface (41) and defines an interior fluid path (42) from the wellhead end (38) to the production end (40) such that the fluid may pass therethrough relatively unimpeded. Thus, as discussed further below, fluid pumped by the rotary pump (26) is conducted through the interior fluid path (42) of the pipe string (36). In other words, in the preferred embodiment, the fluid is pumped form the formation to the surface through the pipe string (36) within the interior fluid path (42).

Referring to FIGS. 1 and 2, the apparatus (20) is further comprised of a swivel device (44) connected into the pipe string (36) between the wellhead end (38) and the production end (40). As a result of the connection of the swivel device (44) into the pipe string (36), the pipe string (36) is comprised of an upper portion (46) and a lower portion (48). The upper portion (46) is defined or provided between the wellhead end (38) of the pipe string (36) and the swivel device (44), while the lower portion (48) is defined or provided between the swivel device (44) and the production end (40) of the pipe string (36). More particularly, the upper portion (46) of the pipe string (36) extends from the wellhead end (38) to a lower end (50) of the upper portion (46), which is associated with the swivel device (44). The lower portion (48) extends from an upper end (52) of the lower portion (48), which is associated with the swivel device (44), to the production end (40). The interior fluid path (42) is defined through both the upper portion (46) and the lower portion (48) of the pipe string (36).

The swivel device (44) is connected into the pipe string (36) in order to permit the upper portion (46) to rotate relative to the lower portion (48). Thus, the swivel device (44) may be comprised of any apparatus, structure or mechanism which provides for or permits the relative rotation between the upper and lower portions (46, 48).

Further, the swivel device (44) may be connected into the pipe string (36), and may be associated with each of the upper and lower portions (46, 48) in any manner and by any mechanism, structure or method permitting the relative rotation of the upper and lower portions (46, 48). For instance, the swivel device (44) may be integrally formed with one or both of the upper and lower portions (46, 48). Alternately, the swivel device (44) may be fixedly connected with one or both of the upper and lower portions (46, 48) or it may be removably coupled, attached or connected with one or both of the upper and lower portions.

Figure 7:
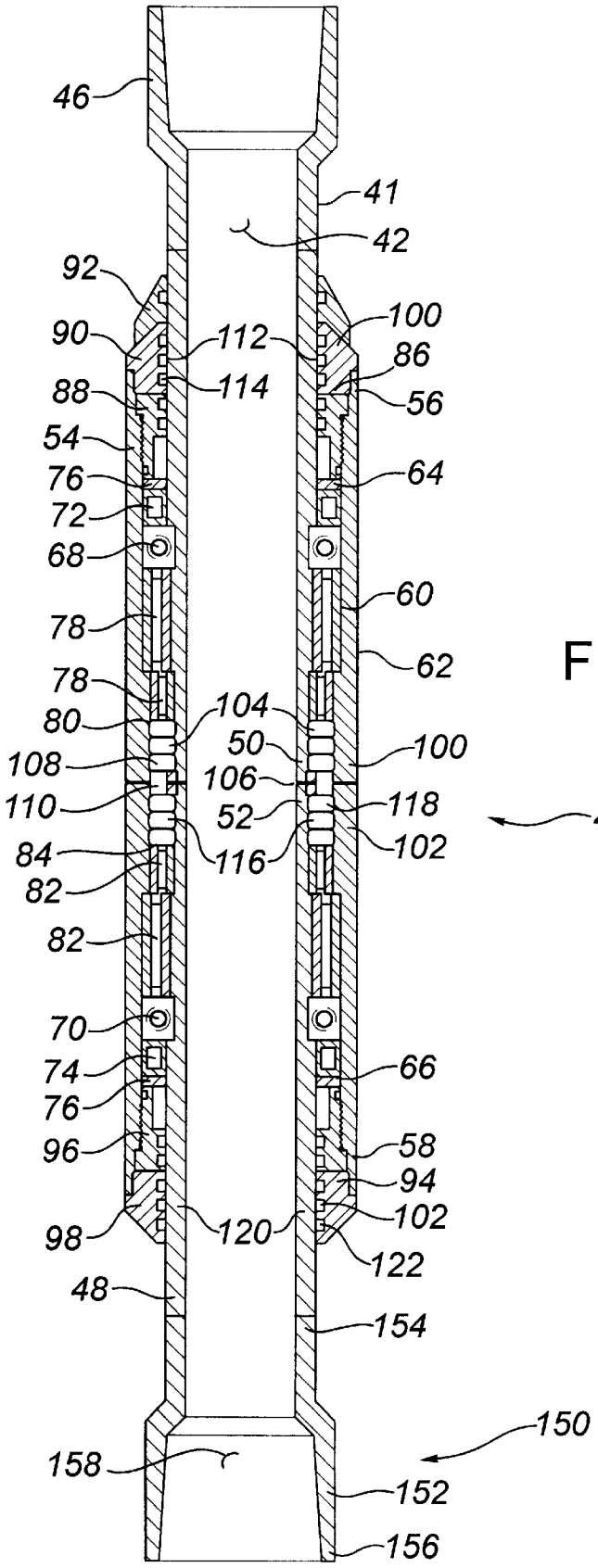
FIG. 7 is a longitudinal sectional view of a swivel device of the apparatus shown in FIG. 2.

Referring to FIG. 7, in the preferred embodiment, the swivel device (44) is comprised of a housing (54) having an upper end (56), a lower end (58), an inner surface (60) and an outer surface (62).

The upper end (56) of the housing (54) is associated with the upper portion (46) of the pipe string (36). More particularly, the lower end (50) of the upper portion (46) extends into the housing (54) through its upper end (56). Further, the lower end (50) of the upper portion (46) is contained and supported within the housing (54), preferably the upper end (56) of the housing (54), such that the swivel device (44) is connected with the upper portion (46) of the pipe string (36), and thus, connected into the pipe string (36).

The lower end (58) of the housing (54) is associated with the lower portion (48) of the pipe string (36). More particularly, the upper end (52) of the lower portion (48) extends into the housing (54) through its lower end (58). Further, the upper end (52) of the lower portion (48) is contained and supported within the housing (54), preferably the lower end (58) of the housing (54), such that the swivel device (44) is connected with the lower portion (48) of the pipe string (36), and thus, connected into the pipe string (36).

The upper and lower portions (46, 48) of the pipe string (36) may be supported within the housing (54) in any manner and by any mechanism, structure or device permitting the upper portion (46) to rotate relative to the lower portion (48). Preferably, the housing (54) is comprised of an upper housing support (64) for engaging the upper portion (46) of the pipe string (36) and a lower housing-support (66) for engaging the lower portion (48) of the pipe string (36). The lower portion (48) of the pipe string (36) and the upper portion (46) of the pipe string (36) are rotatably supported relative to each other by the upper housing support (64) and the lower housing support (66).

In order to permit the relative rotation of the upper and lower portions (46, 48) of the pipe string (36), preferably at least one of the upper housing support (64) and the lower housing support (66) permits rotation of the housing (54) of the swivel device (44) relative to the pipe string (36).

For instance, in the event that the upper housing support (64) permits rotation of the housing (54) relative to the pipe string (36), the upper portion (46) of the pipe string (36) will rotate relative to the housing (54). In the event that the lower housing support (66) permits rotation of the housing (54) relative to the pipe string (36), the upper portion (46) of the pipe string (36) and the housing (54) will rotate together as a unit relative to the lower portion (48) of the pipe string (36).

Again referring to FIG. 7, in the preferred embodiment, both the upper housing support (64) and the lower housing support (66) permit rotation of the housing (54) relative to the pipe string (36) in the manner described above. Thus, in the event that one of the upper or lower housing supports (64, 66) fails or otherwise does not permit rotation of the housing (54) relative to the portion (46, 48) of the pipe string (36) contained therein for any reason, then the other housing support (64, 66) will continue to permit such relative rotation and the continued functioning of the swivel device (44). In this manner, the useful life of the swivel device (44) may be extended.

In the preferred embodiment, the upper housing support (64) is provided to permit the relative rotation of the housing (54) and the pipe string (36), while the lower housing support (66) is provided to act as a back-up in the event of the failure of the upper housing support (64). Thus, typically, the upper housing support (64) will be functional such that the upper portion (46) of the pipe string (36) will rotate relative to the housing (54). However, upon the failure of the upper housing support (64) for any reason, the lower housing support (66) will become functional such that the upper portion (46) of the pipe string (36) and the housing (54) will rotate together as a unit relative to the lower portion (48) of the pipe string (36).

Although the upper and lower housing supports (64, 66) may be comprised of different structural or functional components or elements, preferably, the upper and lower housing supports (64, 66) include substantially similar structural and functional components such that the upper end (56) and the lower end (58) of the housing (54), and the components contained therein, are substantially symmetrical, as shown in FIG. 7.

Referring to FIG. 7, the upper housing support (64) is comprised of an upper hanger ring (68), while the lower housing support (66) is comprised of a lower hanger ring (70). Each of the hanger rings (68, 70) extends between the inner surface (60) of the housing (54) and the adjacent portion (46, 48) of the pipe string (36). The hanger rings (68, 70) maintain the position of the housing (54) longitudinally or axially relative to the upper and lower portions (46, 48) of the pipe string (36), while permitting the portions (46, 48) of the pipe string (36) to rotate therein relative to the housing (54). Further, the hanger rings (68, 70) maintain the positions of the upper and lower portions (46, 48) of the pipe string (36) relative to each other within the housing (54).

In addition, the upper housing support (64) preferably supports the upper portion (46) of the pipe string (36) both radially and axially. Similarly, the lower housing support (66) preferably supports the lower portion (48) of the pipe string (36) both radially and axially. Thus, at least one, and preferably both, of the upper and lower housing supports (64, 66) is comprised of at least one thrust bearing for supporting the pipe string (36) axially and at least radial bearing for supporting the pipe string (36) radially.

More particularly, in the preferred embodiment, the upper housing support (64) is comprised of at least one upper thrust bearing (72). Referring to FIG. 7, the upper thrust bearing (72) is located uphole of, and adjacent to, the upper hanger ring (68) which engages the upper portion (46) of the pipe string (36). As a result, axial movement of the upper portion (46) of the pipe string (36) and the upper hanger ring (68) uphole relative to the housing (54), or towards the upper end (56) of the housing (54), causes the abutment of the upper hanger ring (68) against the upper thrust bearing (72). Accordingly, the upper portion (46) of the pipe string (36) is supported axially within the housing (54) by the upper thrust bearing (72).

Similarly, the lower housing support (66) is comprised of at least one lower thrust bearing (74). Again, referring to FIG. 7, the lower thrust bearing (74) is located downhole of, and adjacent to, the lower hanger ring (70) which engages the lower portion (48) of the pipe string (36). As a result, axial movement of the lower portion (48) of the pipe string (36) and the lower hanger ring (70) downhole relative to the housing (54), or towards the lower end (58) of the housing (54), causes the abutment of the lower hanger ring (70) against the lower thrust bearing (74). Accordingly, the lower portion (48) of the pipe string (36) is supported axially within the housing (54) by the lower thrust bearing (74).

In combination, the upper thrust bearing (72) of the upper housing support (64) and the lower thrust bearing (74) of the lower housing support (66) act together to axially support the pipe string (36), including the upper and lower portions (46, 48), within the housing (54). Further, where necessary, the thrust bearings (72, 74) may be maintained in the proper position within the housing support (64, 66) by one or more spacer shims (76).

In the preferred embodiment, the upper housing support (64) is further comprised of at least one, and preferably two, upper radial bearings (78), wherein each radial bearing (78) is preferably comprised of a needle roller bearing. The upper radial bearings (78) may be located at any position longitudinally along the length of the upper portion (46) of the pipe string (36) between the inner surface (60) of the housing (54) and the adjacent upper portion (46). However, preferably, the upper radial bearings (78) are located downhole of, and adjacent to, the upper hanger ring (68). Thus, the upper radial bearings (78) particularly provide radial support to the upper portion (46) of the pipe string (36) at, adjacent or in proximity to the lower end (50) of the upper portion (46).

Further to assist or enhance the radial support provided by the upper radial bearings (78), the upper housing support (64) may be further comprised of an upper wear ring (80). Particularly, the upper wear ring (80) is preferably positioned about the upper portion (46) of the pipe string (36) between the pipe string (36) and the inner surface (60) of the housing (54). Further, the upper wear ring (80) is preferably positioned longitudinally along the upper portion (46) of the pipe string (36) at, adjacent or in proximity to the lower end (50) of the upper portion (46). In the preferred embodiment, the upper wear ring (80) is located downhole of, and adjacent to, the lowermost upper radial bearing (78).

Further, in the preferred embodiment, the lower housing support (66) is similarly further comprised of at least one, and preferably two, lower radial bearings (82), wherein each lower radial bearing (82) is preferably comprised of a needle roller bearing. The lower radial bearings (82) may be located at any position longitudinally along the length of the lower portion (48) of the pipe string (36) between the inner surface (60) of the housing (54) and the adjacent lower portion (48). However, preferably, the lower radial bearings (82) are located uphole of, and adjacent to, the lower hanger ring (70). Thus, the lower radial bearings (82) particularly provide radial support to the lower portion (48) of the pipe string (36) at, adjacent or in proximity to the upper end (52) of the lower portion (48).

Further to assist or enhance the radial support provided by the lower radial bearings (82), the lower housing support (66) may similarly be further comprised of an lower wear ring (84). Particularly, the lower wear ring (84) is preferably positioned about the lower portion (48) of the pipe string (36) between the pipe string (36) and the inner surface (60) of the housing (54). Further, the lower wear ring (84) is preferably positioned longitudinally along the lower portion (48) of the pipe string (36) at, adjacent or in proximity to the upper end (52) of the lower portion (48). In the preferred embodiment, the lower wear ring (84) is located uphole of, and adjacent to, the uppermost lower radial bearing (82).

Each of the above components of the upper and lower housing supports (64, 66), including the thrust bearings (72, 74), radial bearings (78, 82) and wear rings (80, 84), may be integrally formed with any of the other components comprising the housing supports (64, 66) or may be coupled, attached, affixed or otherwise associated with any of the other components of the housing supports (64, 66). Further, any of the components of the housing supports (64, 66) may also be integrally formed with one or both of the portion (46, 48) of the pipe string (36) within the respective housing support (64, 66) and the housing (54) or coupled, attached, affixed or otherwise associated with one or both of the portion (46, 48) of the pipe string (36) within the respective housing support (64, 66) and the housing (54).

In the preferred embodiment, the swivel device (44) is further comprised of an upper retainer (86) for retaining or assisting in the retention or maintenance of the position of the upper housing support (64) between the housing (54) and the upper portion (46) of the pipe string (36). More particularly, the upper retainer (86) is preferably positioned or disposed between the upper portion (46) of the pipe string (36) and the housing (54) at, adjacent or in proximity to the upper end (56) of the housing (54).

The upper retainer (86) may be comprised of any structure, mechanism or device capable of retaining or maintaining the desired position of the upper housing support (64) as described herein. However, in the preferred embodiment, the upper retainer (86) is comprised of a retainer nut (88) positioned adjacent the upper housing support (64) and a top nut (90) positioned adjacent the retainer nut (88) at the uppermost surface of the upper end (56) of the housing (54), as shown in FIG. 7. Preferably, the retainer nut (88) and the top nut (90) are threadably coupled or connected with the inner surface (60) of the housing (54) at the upper end (56) thereof. Further, the upper portion (46) of the pipe string (36) is permitted to rotate therein.

As well, a top sand shield (92) may be coupled or attached with the top nut (90) where necessary or desired to inhibit the entry of any sand or debris through the upper end (56) of the housing (54) into the swivel device (44).

In addition, in the preferred embodiment, the swivel device (44) is further comprised of a lower retainer (94) for retaining or assisting in the retention or maintenance of the position of the lower housing support (66) between the housing (54) and the lower portion (48) of the pipe string (36). More particularly, the lower retainer (94) is preferably positioned or disposed between the lower portion (48) of the pipe string (36) and the housing (54) at, adjacent or in proximity to the lower end (58) of the housing (54).

The lower retainer (94) may be comprised of any structure, mechanism or device capable of retaining or maintaining the desired position of the lower housing support (66) as described herein. However, in the preferred embodiment, the lower retainer (94) is comprised of a retainer nut (96) positioned adjacent the lower housing support (66) and a bottom nut (98) positioned adjacent the retainer nut (96) at the lowermost surface of the lower end (58) of the housing (54), as shown in FIG. 7. Preferably, the retainer nut (96) and the bottom nut (98) are threadably coupled or connected with the inner surface (60) of the housing (54) at the lower end (58) thereof. Further, the lower portion (48) of the pipe string (36) is permitted to rotate therein.

Finally, the swivel device (44) is preferably comprised of an upper seal assembly (100) for sealing between the upper portion (46) of the pipe string (36) and the housing (54) and a lower seal assembly (102) for sealing between the lower portion (48) of the pipe string (36) and the housing (54). The upper seal assembly (100) substantially seals between at least one, and preferably both, of the lower end (50) of the upper portion (46) of the pipe string (36) and the adjacent housing (54) and the upper end (56) of the housing (54) and the adjacent upper portion (46) of the pipe string (36). Thus, fluid and debris are inhibited from entering the annular space between the housing (54) and the upper portion (46) of the pipe string (36) , and more particularly, from entering the upper housing support (64).

Similarly, the lower seal assembly (102) substantially seals between at least one, and preferably both, of the upper end (52) of the lower portion (48) of the pipe string (36) and the adjacent housing (54) and the lower end (58) of the housing (54) and the adjacent lower portion (48) of the pipe string (36). Thus, fluid and debris are inhibited from entering the annular space between the housing (54) and the lower portion (48) of the pipe string (36), and more particularly, from entering the lower housing support (66).

Each seal assembly (100, 102) may be comprised of one or more seals, sealing devices or other suitable sealing structures able to provide the desired sealing between the pipe string (36) and the housing (54) of the swivel device (44).

In the preferred embodiment, the upper seal assembly (100) is comprised of an inner sealing structure (104) positioned between the lower end (50) of the upper portion (46) of the pipe string (36) and the adjacent housing (54). The inner sealing structure (104) is provided to inhibit the passage of fluid and debris which may enter into the swivel device (44) through the gap (106) between the lower end

(50) of the upper portion (46) of the pipe string (36) and the upper end (52) of the lower portion (58) of the pipe string (36). In the preferred embodiment, the inner sealing structure (104) is comprised of one or more seals (108) or sealing devices carried on a seal carrier (110) positioned adjacent the gap (106).

In the preferred embodiment, the upper seal assembly (100) is also comprised of an outer sealing structure (112) positioned between the upper end (56) of the housing (54) and the adjacent upper portion (46) of the pipe string (36). The outer sealing structure (112) is provided to inhibit the passage of fluid and debris which may enter into the swivel device (44) through the upper end (56) of the housing (54). In the preferred embodiment, the outer sealing structure (112) is comprised of one or more seals (114) disposed on or associated with at least one, and preferably both, of the upper retainer (86), including one or both of the retainer nut (88) and the top nut (90), and the top sand shield (92). Specifically, the seals (114) are positioned between the upper portion (46) of the pipe string (36) and the adjacent inner surfaces of each of the retainer nut (88), top nut (90) and top sand shield (92). Further, where necessary, one or more seals (114) may be located between the outer surface of the upper retainer (86) and the adjacent inner surface (60) of the housing (54).

In the preferred embodiment, the lower seal assembly (102) is also comprised of an inner sealing structure (116) positioned between the upper end (52) of the lower portion (48) of the pipe string (36) and the adjacent housing (54). This inner sealing structure (116) is also provided to inhibit the passage of fluid and debris which may enter into the swivel device (44) through the gap (106) between the lower end (50) of the upper portion (46) of the pipe string (36) and the upper end (52) of the lower portion (58) of the pipe string (36). In the preferred embodiment, the inner sealing structure (116) is comprised of one or more seals (118) or sealing devices carried on the seal carrier (110) positioned adjacent the gap (106).

In the preferred embodiment, the lower seal assembly (102) is also comprised of an outer sealing structure (120) positioned between the lower end (58) of the housing (54) and the adjacent lower portion (48) of the pipe string (36). The outer sealing structure (120) is provided to inhibit the passage of fluid and debris which may enter into the swivel device (44) through the lower end (58) of the housing (54). In the preferred embodiment, the outer sealing structure (120) is comprised of one or more seals (122) disposed on or associated with the lower retainer (94), including one or both of the retainer nut (96) and the bottom nut (98). Specifically, the seals (122) are positioned between the lower portion (48) of the pipe string (36) and the adjacent inner surfaces of each of the retainer nut (96) and the bottom nut (98). Further, where necessary, one or more seals (122) may be located between the outer surface of the lower retainer (94) and the adjacent inner surface (60) of the housing (54).

Further, referring to FIGS. 1, 2, 5 and 6, the apparatus (20) is further comprised of an upper connector (124) for connecting the upper portion (46) of the pipe string (36) with the rotor (32) of the rotary pump (26) such that rotation of the upper portion (46) will result in rotation of the rotor (32) and in pumping of the fluid by the pump (26). The upper connector (124) may be comprised of any apparatus, structure or mechanism capable of connecting the upper portion (46) of the pipe string (36) with the rotor (32) of the rotary pump (26) in order to actuate the rotor (32). However, preferably, the upper connector (124) is comprised of a drive sub collar (126), as particularly shown in FIGS. 5 and 6.

The drive sub collar (126) has an upper end (128), a lower end (130), an inner surface (132) and an outer surface (134). The drive sub collar (126) is connected into the upper portion (46) of the pipe string (36) such that rotation of the upper portion (46) will result in rotation of the drive sub collar (126). The drive sub collar (126) may be connected, coupled or otherwise mounted into the upper portion (46) of the pipe string (36) by any structure, mechanism or device able to provide the necessary connection into the upper portion (46). However, in the preferred embodiment, the upper end (128) and the lower end (130) of the drive sub collar (126) are connected or coupled with the upper portion (46) of the pipe string (36) located above and below the drive sub collar (126). More particularly, the inner surface (132) of the drive sub collar (126) adjacent the upper and lower ends (128, 130) includes a threaded box end for connection or coupling with a threaded pin end of the adjacent pipe string (36).

Further, the drive sub collar (126) is comprised of a rotor connector (136) for connecting the rotor (32) of the pump (26) to the drive sub collar (126) such that rotation of the upper portion (46) of the pipe string (36) and the drive sub collar (126) will result in rotation of the rotor (32). The rotor connector (136) may be comprised of any apparatus, structure or mechanism capable of connecting the rotor (32) to the drive sub collar (126).

In the preferred embodiment, the rotor connector (136) has an upper end (138), a lower end (140) and an outer surface (142) and defines a bore (144) extending between the upper and lower ends (138, 140). Further, in the preferred embodiment, the outer surface (142) of the rotor connector (136) is integrally formed with the inner surface (132) of the drive sub collar (126) between the upper and lower ends (128, 130) of the drive sub collar (126). The rotor (32) of the pump (26) is connected or coupled with the bore (144) of the rotor connector (136). More particularly, the bore (144) of the rotor connector (136) preferably provides a threaded inner surface for coupling with a threaded outer surface of the rotor (32) located therein. However, any other mechanism, structure or device for connecting or coupling the rotor connector (136) with the drive sub collar (126) and for connecting or coupling the rotor (32) with the rotor connector (136) may be used. Preferably the rotor connector (136) is connected or coupled with the uppermost end of the rotor (32), however, it may be coupled at any location along the length of the rotor (32). Thus, the length of the rotor (32) to be used with the within invention is dependent upon, amongst other factors, the location of the coupling of the rotor connector (136) along the length of the rotor (32) and the distance between the rotor connector (136) and the rotary pump (26).

Further, the drive sub collar (126) and the rotor connector (136) are preferably rotatable about a common axis. Thus, the rotor (32) is substantially centrally located within the pipe string (36) and properly positioned within the stator (34) of the pump (26). Accordingly, in the preferred embodiment, the rotor connector (136) is located concentrically within the drive sub collar (126). Further, the bore (144) of the rotor connector (136) is preferably centrally located therein.

In addition, in order that fluids may be pumped through the interior fluid path (42) of the pipe string (36), the drive sub collar (126) defines an interior fluid passage (146) for permitting fluid to be conducted between the upper end (128) and the lower end (130) of the drive sub collar (126). In the preferred embodiment, the interior fluid passage (146) is comprised of a plurality of fluid channels (148) surrounding the rotor connector (136) More particularly, the fluid channels (148) are spaced or positioned about the bore (144) of the rotor connector (136) and extend between the upper and lower ends (138, 140) of the rotor connector (136). Thus, the interior fluid passage (146) of the drive sub collar (126) includes the inner surface (132) of the drive sub collar (126) above and below the rotor connector (136) and the fluid channels (148) through the rotor connector (136).

Figure 6:
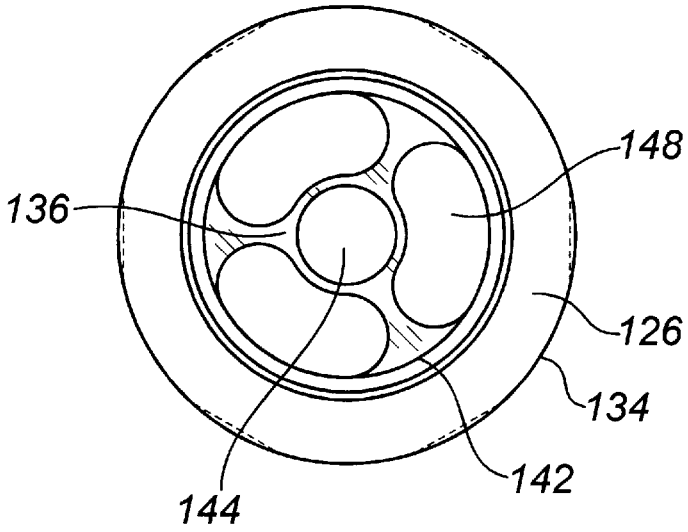
FIG. 6 is a cross-sectional view of the drive sub collar taken along line 6—6 of FIG. 5.
Figure 5:
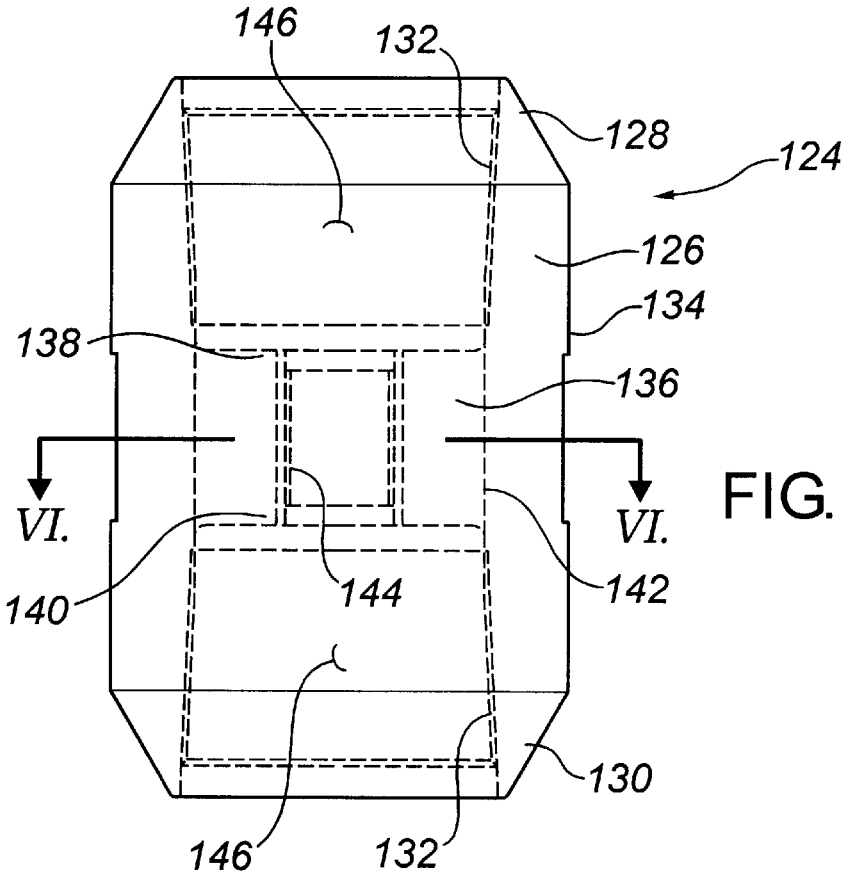
FIG. 5 is a longitudinal sectional view of a drive sub collar of the apparatus shown in FIG. 2.

Although the rotor connector (136) may define any number of fluid channels (148) therethrough, in the preferred embodiment, the rotor connector (136) defines three fluid channels (148) as shown in FIG. 6. Further, the fluid channels (148) may have any shape or configuration permitting the passage of fluid therethrough. However, in the preferred embodiment, the fluid channels (148) are elliptical or kidney-shaped when viewed from above.

Further, as shown in FIGS. 1, 2 and 7, the apparatus (20) is comprised of a lower connector (150) for connecting the lower portion (48) of the pipe string (36) with the stator (34) of the rotary pump (26) such that fluid pumped by the pump (26) is conducted through the interior fluid path (42) of the pipe string (36). The lower connector (150) is thus located or positioned at, adjacent or in proximity to the production end (40) of the pipe string (36). Further, the lower connector (150) is preferably attached, connected, coupled or otherwise associated with the production end (40).

The lower connector (150) of the apparatus (20) may be comprised of any apparatus, structure or mechanism capable of connecting the lower portion (48) of the pipe string (36) with the stator (34) in the manner described above. In the preferred embodiment, as shown in FIG. 1, the lower connector (150) is comprised of a connector collar (152) which is integrally formed with the lower portion (48) of the pipe string (36) at the production end (40).

More particularly, as shown in FIG. 7, the connector collar (152) includes an upper end (154) and a lower end (156) and defines an interior fluid passage (158) for permitting fluid to be conducted between the upper end (154) and the lower end (156) of the connector collar (152). Thus, the connector collar (152) does not significantly interfere with or impede the passage of fluids therethrough between the interior fluid path (42) of the pipe string (36) and the rotary pump (26). The upper end (154) of the connector collar (152) is integrally formed with the production end (40) of the pipe string (36). The lower end (156) of the connector collar (152) includes a threaded inner or outer surface, preferably a threaded box connection, for connection or coupling with an adjacent threaded inner or outer surface, preferably a threaded pin connection, provided by the stator (34) of the rotary pump (26).

As well, referring to FIGS. 1 through 4, the apparatus (20) is further preferably comprised of at least one stabilizing collar (160) mounted on or about the exterior surface (41) of the upper portion (46) of the pipe string (36) for centralizing the upper portion (46) of the pipe string (36) in the wellbore (22). In the preferred embodiment, the apparatus (20) is comprised of a plurality of stabilizing collars (160) spaced longitudinally along the upper portion (46) of the pipe string (36).

In the preferred embodiment, the stabilizing collar (160) is rotatably mounted about the exterior surface (41) of the upper portion (46) of the pipe string (36). In other words, the upper portion (46) of the pipe string (36) is rotatable within, or relative to, the stabilizing collar (160). More particularly, the stabilizing collar (160) includes an inner surface (162) for surrounding the exterior surface (41) of the pipe string (36) and an outer surface (164) for contacting an inner surface of the wellbore (22).

Figure 4:
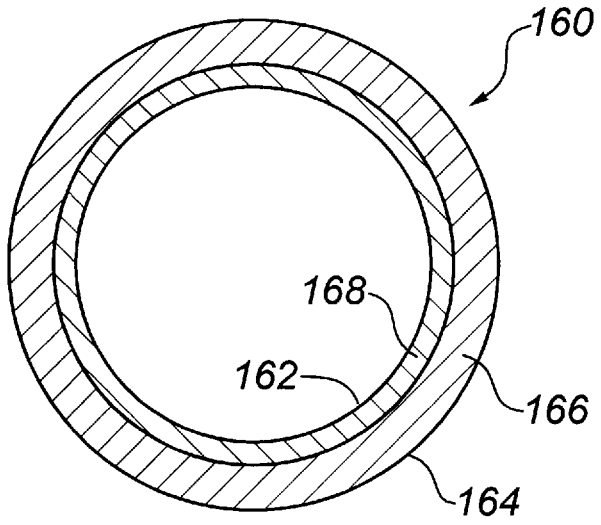
FIG. 4 is a cross-sectional view of the stabilizing collar taken along line 4—4 of FIG. 3.
Figure 3:
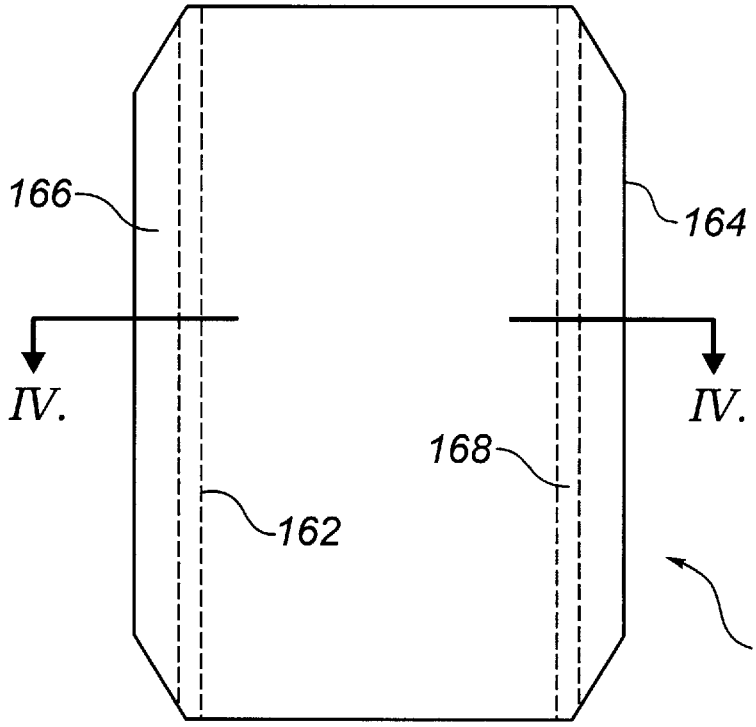
FIG. 3 is a longitudinal sectional view of a stabilizing collar of the apparatus shown in FIG. 2.

In the preferred embodiment, as particularly shown in FIGS. 3 and 4, the stabilizing collar (160) is comprised of an outer sleeve (166) which provides or defines the outer surface (162) for contacting the wellbore (22). The outer sleeve (166) is preferably comprised of a material which will not substantially abrade the inner surface of the wellbore (22) in the event of some rotation of the outer sleeve (166) relative to the wellbore (22). Although any non-abrading material may be used, in the preferred embodiment, the outer sleeve (166) of the stabilizing collar (160) is comprised of a polyurethane.

Further, in the preferred embodiment, the stabilizing collar (160) is comprised of an inner sleeve (168) which provides or defines the inner surface (162) for engaging the exterior surface (41) of the pipe string (36). The inner sleeve (168) is fixedly mounted, connected or molded with an inner surface of the outer sleeve (166) and is rotatably mounted or disposed about the exterior surface (41) of the pipe string (36). Although the inner sleeve (168) may be comprised of any structure, mechanism or device permitting the rotation of the pipe string (36) therein, the inner sleeve (168) is preferably comprised of a bushing or bearing. More preferably, the inner sleeve (168) is comprised of an oilite bushing.

Referring to FIGS. 1 and 2, the apparatus (20) is further preferably comprised of a wellhead support (170) located at the wellhead end (38) of the pipe string (36) for supporting the pipe string (36) in the wellbore (22). In the preferred embodiment, the wellhead support (170) rotatably supports the pipe string (36) in the wellbore (22) such that the upper portion (46) of the pipe string (36) may be rotated within the wellbore (22).

The wellhead support (170) may be comprised of a casing bowl or tubing head which engages a dognut attached to the pipe string (36) to support the pipe string (36). The wellhead support (170) may also be comprised of more than one structure for supporting the pipe string (36) instead of a single structure.

In the preferred embodiment, the wellhead support (170) is comprised of a support flange (172) positioned at the uppermost end of the wellbore (22) at the surface. More preferably, the wellhead support (170) is mounted or connected directly or indirectly with, the uppermost end of the casing string (24), being the casing head (173). Further, the wellhead support (170) is preferably comprised of a tubular mandrel (174) rotatably supported within the support flange (172).

In the preferred embodiment, the tubular mandrel (174) has an upper driven end (176) and a lower drive end (178) and defines a bore (180) therein for the passage of fluids between the driven and drive ends (176, 178). The lower drive end (178) is adapted for connection with the wellhead end (38) of the pipe string (36). Any mechanism, structure or device may be provided for connecting or coupling the lower drive end (178) with the wellhead end (38) of the pipe string (36). However, preferably, a threaded connection is provided between the lower drive end (178) of the mandrel (174) and the wellhead end (38) of the pipe string (36). The threaded connection is such that fluids are permitted to pass between the bore (180) of the mandrel (174) and the interior fluid path (42) of the pipe string (36).

Further, the mandrel (174) may be supported within the support flange (172) by any mechanism, structure or device which permits or provides for the rotation of the mandrel (174) within or relative to the support flange (172). However, in the preferred embodiment, an outer surface of the mandrel (174) is comprised of a projection (182) or extension which projects from the outer surface and thereby provides a downwardly facing shoulder (184). The downwardly facing shoulder (184) rests upon and is rotatably supported by a thrust bearing (186) within the support flange (172).

Further, the wellhead support (170) may be further comprised of an alignment flange (188) which allows or accommodates for some amount of misalignment or incompatibility between the casing head (173) the support flange (172). Preferably, the alignment flange (188) permits or allows for a 2 to 3 degree misalignment. In the preferred embodiment, the alignment flange (188) is mounted or disposed between the casing head (173) and the support flange (172) such that the drive end (178) of the mandrel (174) extends through the alignment flange (188) for connection with the pipe string (36).

Further, in the preferred embodiment, the alignment flange (188) is comprised of a metal gasket (190) between the lowermost surface of the support flange (172) and the uppermost surface of the alignment flange (188).

The support flange (172) may be supplemented with or replaced by some other structure for supporting the pipe string (36) as the wellhead support (170), such as for example a dognut system as described above.

As shown in FIGS. 1 and 2, the apparatus (20) is preferably further comprised of a drive system (192) connected directly or indirectly with the upper portion (46) of the pipe string (36) for rotating the upper portion (36) of the pipe string (36). Accordingly, actuation of the drive system (192) actuates the rotary pump (26). The drive system (192) may be directly or indirectly connected with the upper portion (46) of the pipe string (36) at any location or position longitudinally along the length of the upper portion (46). However, preferably, the drive system (192) is directly or indirectly connected with the upper portion (46) at, adjacent or in proximity to the wellhead end (38) of the pipe string (36).

More particularly, in the preferred embodiment, the drive system (192) is drivingly connected or associated with the driven end (176) of the mandrel (174). Thus, rotation of the mandrel (174) by the drive system (192) results in the corresponding rotation of the upper portion (46) of the pipe string (36) connected with the drive end (178) of the mandrel (174). Rotation of the upper portion (46) of the pipe string (36) results in the rotation of the rotor (32) of the rotary pump (26) and pumping of the fluid thereby.

The drive system (192) may be comprised of any device, structure, mechanism or motor capable of drivingly engaging the driven end (176) of the mandrel (174) such that the mandrel (174) may be rotated by the drive system (192). Preferably the drive system (192) is comprised of a motor (194), preferably a hydraulic motor, which drivingly engages the driven end (176) of the mandrel (174) by use of a gear system (196) including a drive shaft (198). Alternatively, the drive system (192) may engage the pipe string (36) or the mandrel (174) with the use of a belt drive, a chain drive or some other apparatus. In the preferred embodiment, the motor (194) actuates the drive shaft (198) through the gear system (196), which drive shaft (198) drivingly engages the mandrel (174).

For example, the motor (194) may operate at 1000 rpm and provides 210 ft-lbs of torque. As a result of gearing down by the gear system (196) at a ratio of 10:1, the pipe string (36) is rotated at 100 rpm and provides 2100 ft-lbs of torque.

Given the specific configuration of the apparatus (20) and the actuation of the rotor (32) by rotation of the pipe string (36), it has been found that the rotary pump (26) may be operated at a higher capacity, thus enhancing the production from the wellbore (22). Specifically, the drive system (192) is able to transmit a greater amount of torque to the rotor (32) through the pipe string (36), as compared to conventional systems in which the torque is transmitted to the pump (26) by a rod string. With the ability to transmit increased torque to the rotor (32), the more likely it is that the pump (26) may be operated at or near its maximum capacity.

However, given the ability to transmit greater amounts of torque to the rotor (32), the drive system (192) must be monitored or specifically designed to transmit an amount of torque which will not exceed the capacity of the pump (26) and thereby overstress the pump (26) resulting in its failure. For this reason, it may be desirable to build a fail-safe mechanism into the apparatus (20) to prevent over-torquing of the pump (26), such as a shearable pin which shears in the event of excessive torque being provided by the pipe string (36) prior to any damage being incurred by the pump (26).

Finally, referring to FIGS. 1 and 2, the apparatus (20) is preferably further comprised of a torque anchor (200), where necessary, to inhibit rotation of the stator (34) within the wellbore (22) upon rotation of the rotor (32) therein. The torque anchor (200) may be comprised of any device, structure or mechanism capable of inhibiting the rotation of the stator (34) within the wellbore (22). However, preferably, the torque anchor (200) is mounted, connected or otherwise associated with the stator (34).

For instance, the torque anchor (200) may be integrally formed with the stator (34) of the rotary pump (26). Alternately, the torque anchor (200) may be fixedly connected with the stator (34), such as by welding, or it may be removably coupled or attached directly or indirectly with the stator (34), such as by a threaded coupling or connection. In the preferred embodiment, a threaded connection is provided between a lower end of the stator (34) and an upper end of the torque anchor (200).

In the method embodiment of the invention, the method may be performed using any apparatus compatible with and suitable for performing the method. However, the method of the within invention is preferably performed using the apparatus (20) of the within invention, and more preferably, the preferred embodiment of the apparatus (20) described herein.

The method of the within invention is provided for pumping fluids from the wellbore (22) and is comprised of the step of rotatably supporting the upper portion (46) of the pipe string (36) in the wellbore (22) at the wellhead end (38) of the pipe string (36). The rotatably supporting step may be performed in any manner and using any method, structure, mechanism or device capable of rotatably supporting the upper portion (46) in the wellbore (22) at, adjacent or in proximity to the wellhead end (38) of the pipe string (36).

However, in the preferred embodiment, the rotatably supporting step is comprised of providing the wellhead support (170) at the wellhead end (38) of the pipe string (36). Further, the rotatably supporting step is preferably comprised of mounting, connecting, coupling or otherwise associating the upper portion (46) of the pipe string (36) with the wellhead support (170) at, adjacent or in proximity to the wellhead end (38) of the pipe string (36) in a manner such that the pipe string (36) is rotatably supported within the wellbore (22) by the wellhead support (170).

Further, the method is comprised of the step of connecting the lower portion (48) of the pipe string (36) with the stator

(34) of the rotary pump (26) at the production end (40) of the pipe string (36), wherein the upper portion (46) and the lower portion (48) of the pipe string (36) are capable of rotating relative to each other. The lower portion (48) connecting step may be performed in any manner and using any method, structure, mechanism or device capable of connecting the lower portion (48) and the stator (34) such that the fluid pumped by the pump (26) may be conducted through the interior fluid path (42) of the pipe string (36).

However, in the preferred embodiment, the lower portion connecting step is comprised of providing the lower connector (150) for connecting the lower portion (48) of the pipe string (36) with the stator (34). Further, the lower portion connecting step is preferably comprised of mounting, connecting, coupling or otherwise associating the lower portion (48) at the production end (40) of the pipe string (36) and the stator (34) with the lower connector (150) in a manner such that the fluid may be conducted between the pump (26) and the interior fluid path (42) of the pipe string (36).

In addition, the method is comprised of the step of connecting the upper portion (46) of the pipe string (36) with the rotor (32) of the rotary pump (26). The upper portion connecting step may be performed in any manner and using any method, structure, mechanism or device capable of connecting the upper portion (46) and the rotor (32) such that rotation of the upper portion (46) results in rotation of the rotor (32).

However, in the preferred embodiment, the upper portion connecting step is comprised of providing the upper connector (124) for connecting the upper portion (46) of the pipe string (36) with the rotor (32). Further, the upper portion connecting step is preferably comprised of mounting, connecting, coupling or otherwise associating the upper portion (46) of the pipe string (36) and the rotor (32) with the upper connector (124) in a manner such that rotation of the upper portion (46) results in rotation of the rotor (32) and thus, pumping of the fluid.

The method of the invention is further comprised of the step of positioning the pump (26) in the wellbore (22). The positioning step may be performed in any manner and using any method, structure, mechanism or device capable of positioning the pump (26) in the wellbore (22). The positioning step may be performed prior to one or both of the upper portion connecting step and the lower portion connecting step. Thus, the pump (26) may be positioned in the wellbore (22) before being connected with the pipe string (36), or with either or both of the upper and lower portions (46, 48) of the pipe string (36).

However, in the preferred embodiment, the positioning step is performed following both the upper portion connecting step and the lower portion connecting step. Thus, preferably, the pump (26) is positioned in the wellbore (22) after being connected with the pipe string (36). In other words, the pump (26) is preferably positioned in the wellbore (22) after being connected with both the upper portion (46) and the lower portion (48) of the pipe string (36).

The method is then comprised of the step of rotating the upper portion (46) of the pipe string (36) in order to rotate the rotor (32) of the rotary pump (26) to pump the fluid and in order to conduct the fluid through the interior fluid path (42) in the pipe string (36). The rotating step may be performed in any manner and using any method, structure, mechanism or device capable of rotating the upper portion (46) of the pipe string (36) in the wellbore (22).

However, in the preferred embodiment, the rotating step is comprised of providing the drive system (192). Further, the rotating step is preferably comprised of mounting, connecting, coupling or otherwise associating the upper portion (46) of the pipe string (36) directly or indirectly with the drive system (192), preferably at, adjacent or in proximity to the wellhead end (38) of the pipe string (36).

Finally, the method may be further comprised of the step of anchoring the stator (34) in the wellbore (22) during rotation of the upper portion (46) of the pipe string (36) in order to inhibit rotation of the stator (34). The anchoring step may be performed in any manner and using any method, structure, mechanism or device capable of anchoring the stator (340 in the wellbore (22). However, in the preferred embodiment, the anchoring step is comprised of mounting, connecting, coupling or otherwise associating the torque anchor (200) with the stator (34) of the rotary pump (26).

The embodiments of the invention in which an exclusive property or privilege is claimed are defined as follows:

1. An apparatus for use in pumping fluids in a wellbore, the apparatus comprising:

(a) a pipe string positioned in the wellbore and extending between a wellhead end of the pipe string and a production end of the pipe string, the pipe string defining an interior fluid path from the wellhead end to the production end;

(b) a swivel device connected into the pipe string between the wellhead end and the production end so that an upper portion of the pipe string between the wellhead end and the swivel device may rotate relative to a lower portion of the pipe string between the swivel device and the production end;

(c) a lower connector for connecting the lower portion of the pipe string with a stator of a rotary pump positioned at the production end of the pipe string such that a fluid which is pumped by the pump is conducted through the interior fluid path of the pipe string; and (d) an upper connector for connecting the upper portion of the pipe string with a rotor of the rotary pump such that rotation of the upper portion of the pipe string will result in rotation of the rotor and in pumping of the fluid by the pump.

2. The apparatus as claimed in claim 1 wherein the swivel device is comprised of a housing for containing a lower end of the upper portion of the pipe string and for containing an upper end of the lower portion of the pipe string.

3. The apparatus as claimed in claim 2 wherein the housing is comprised of an upper housing support for engaging the upper portion of the pipe string, wherein the housing is comprised of a lower housing support for engaging the lower portion of the pipe string, and wherein the lower portion of the pipe string and the upper portion of the pipe string are rotatably supported relative to each other by the upper housing support and the lower housing support.

4. The apparatus as claimed in claim 3 wherein at least one of the upper housing support and the lower housing support permit rotation of the housing relative to the pipe string.

5. The apparatus as claimed in claim 4 wherein the swivel device is further comprised of an upper seal assembly for sealing between the upper portion of the pipe string and the housing and wherein the swivel device is further comprised of a lower seal assembly for sealing between the lower portion of the pipe string and the housing.

6. The apparatus as claimed in claim 5 wherein the upper housing support supports the upper portion of the pipe string both radially and axially, and wherein the lower housing support supports the lower portion of the pipe string both radially and axially.

7. The apparatus as claimed in claim 5 wherein both the upper housing support and the lower housing support permit rotation of the housing relative to the pipe string.

8. The apparatus as claimed in claim 1 wherein the upper connector is comprised of a drive sub collar which is connected into the upper portion of the pipe string such that rotation of the upper portion of the pipe string will result in rotation of the drive sub collar.

9. The apparatus as claimed in claim 8 wherein the drive sub collar is comprised of a rotor connector for connecting the rotor of the pump to the drive sub collar such that rotation of the upper portion of the pipe string and the drive sub collar will result in rotation of the rotor.

10. The apparatus as claimed in claim 9 wherein the drive sub collar is comprised of an upper end and a lower end and wherein the drive sub collar defines an interior fluid passage for permitting fluid to be conducted between the upper end and the lower end of the drive sub collar.

11. The apparatus as claimed in claim 10 wherein the rotor connector is located concentrically within the drive sub collar so that the drive sub collar and the rotor connector are rotatable about a common axis.

12. The apparatus as claimed in claim 11 wherein the interior fluid passage defined by the drive sub collar is comprised of a plurality of fluid channels surrounding the rotor connector.

13. The apparatus as claimed in claim 1 wherein the pipe string is further comprised of an exterior surface, further comprising at least one stabilizing collar mounted on the exterior surface of the upper portion of the pipe string for centralizing the pipe string in the wellbore.

14. The apparatus as claimed in claim 13 wherein the stabilizing collar is rotatably mounted on the exterior surface of the upper portion of the pipe string.

15. The apparatus as claimed in claim 14 wherein the stabilizing collar is comprised of an inner surface for surrounding the exterior surface of the pipe string, wherein the stabilizing collar is further comprised of an outer sleeve for contacting an inner wellbore surface, and wherein the outer sleeve is comprised of a material which will not abrade substantially the inner wellbore surface.

16. The apparatus as claimed in claim 15 wherein the outer sleeve of the stabilizing collar is comprised of a polyurethane.

17. The apparatus as claimed in claim 16 wherein the apparatus is comprised of a plurality of stabilizing collars spaced longitudinally along the upper portion of the pipe string.

18. The apparatus as claimed in claim 1 further comprising a wellhead support located at the wellhead end of the pipe string for supporting the pipe string in the wellbore.

19. The apparatus as claimed in claim 18 wherein the wellhead support rotatably supports the pipe string in the wellbore.

20. The apparatus as claimed in claim 19 further comprising a drive system connected with the upper portion of the pipe string for rotating the upper portion of the pipe string.

21. The apparatus as claimed in claim 20 wherein the drive system is connected with the upper portion of the pipe string adjacent to the wellhead end of the pipe string.

22. A method for pumping fluids from a wellbore comprising the following steps:

(a) rotatably supporting an upper portion of a pipe string in a wellbore at a wellhead end of the pipe string;

(b) connecting a lower portion of the pipe string with a stator of a rotary pump at a production end of the pipe string, wherein the upper portion of the pipe string and the lower portion of the pipe string are capable of rotating relative to each other;

(c) connecting the upper portion of the pipe string with a rotor of the rotary pump;

(d) positioning the pump in the wellbore; and (e) rotating the upper portion of the pipe string relative to the lower portion of the pipe string in order to rotate the rotor within the stator of the rotary pump to pump a fluid and in order to conduct the fluid through an interior fluid path in the pipe string.

23. The method as claimed in claim 22 further comprising the step of anchoring the stator in the wellbore during rotation of the upper portion of the pipe string in order to inhibit rotation of the stator.

24. The method as claimed in claim 22 wherein the pump is positioned in the wellbore before being connected with the pipe string.

25. The method as claimed in claim 22 wherein the pump is positioned in the wellbore after being connected with the pipe string.

* * * * *